US007604538B2

(12) United States Patent
Pacey

(10) Patent No.: US 7,604,538 B2
(45) Date of Patent: Oct. 20, 2009

(54) SLOT MACHINE WITH A REGENERATING BONUS ARRAY

(75) Inventor: Larry J. Pacey, Northbrook, IL (US)

(73) Assignee: WMS Gaming Inc., Waukegan, IL (US)

( * ) Notice: Subject to any disclaimer, the term of this patent is extended or adjusted under 35 U.S.C. 154(b) by 989 days.

(21) Appl. No.: 10/712,951

(22) Filed: Nov. 13, 2003

(65) Prior Publication Data

US 2005/0107154 A1 May 19, 2005

(51) Int. Cl.
*A63F 9/24* (2006.01)

(52) U.S. Cl. ..... 463/20

(58) Field of Classification Search ..... 463/16–22, 463/13

See application file for complete search history.

(56) References Cited

U.S. PATENT DOCUMENTS

| | | | | |
|---|---|---|---|---|
| 5,704,835 | A | 1/1998 | Dietz, II | 463/20 |
| 5,833,537 | A | 11/1998 | Barrie | 463/21 |
| 5,997,401 | A | 12/1999 | Crawford | 463/20 |
| 6,089,977 | A | 7/2000 | Bennett | 463/20 |
| 6,251,013 | B1 | 6/2001 | Bennett | 463/13 |
| 6,270,412 | B1 | 8/2001 | Crawford et al. | 463/20 |
| 6,394,902 | B1 * | 5/2002 | Glavich et al. | 463/20 |
| 6,419,579 | B1 | 7/2002 | Bennett | 463/20 |
| 6,494,454 | B2 * | 12/2002 | Adams | 273/292 |
| 6,561,900 | B1 | 5/2003 | Baerlocher et al. | 463/20 |
| 6,565,433 | B1 | 5/2003 | Baerlocher et al. | 463/20 |
| 6,910,962 | B2 | 6/2005 | Marks et al. | 463/16 |
| 2002/0068623 | A1 | 6/2002 | Gauselmann | 463/20 |
| 2003/0022712 | A1 | 1/2003 | Locke | 463/20 |
| 2003/0022713 | A1 | 1/2003 | Jasper et al. | 463/20 |
| 2003/0064779 | A1 | 4/2003 | Suda | 463/20 |
| 2003/0069062 | A1 | 4/2003 | Shimizu | 463/20 |
| 2003/0092480 | A1 | 5/2003 | White et al. | 463/20 |
| 2003/0157981 | A1 * | 8/2003 | Marks et al. | 463/20 |
| 2004/0033829 | A1 | 2/2004 | Pacey et al. | 463/20 |
| 2004/0043809 | A1 | 3/2004 | Gomez et al. | 463/16 |

* cited by examiner

*Primary Examiner*—John M Hotaling
*Assistant Examiner*—Eric M Thomas
(74) *Attorney, Agent, or Firm*—Nixon Peabody LLP

(57) ABSTRACT

A slot machine type wagering game having a bonus feature that is activated by a start-bonus outcome in the basic game. For example, one start-bonus game outcome may be the occurrence of a winning pay line in the base game array. Certain symbols on the winning pay line are replaced to create a bonus array; all other symbols in the bonus array remain the same, and in the same position, as in the original base array. The replacement symbols are randomly determined. Once the symbols are replaced, the bonus array is checked for winning symbol combinations on active pay lines. If the bonus array forms winning symbol combinations (i.e., a winning pay line), a second start-bonus game outcome may be triggered and the process continues until an array is created that does not form any winning pay lines.

20 Claims, 11 Drawing Sheets

SLOT MACHINE WITH A REGENERATING BONUS ARRAY

FIELD OF THE INVENTION

The present invention relates generally to gaming machines and, more particularly, to a bonusing game triggered by a start-bonus game outcome on a slot type gaming machine.

BACKGROUND OF THE INVENTION

Gaming machines, such as slot machines, video poker machines and the like, have been a cornerstone of the gaming industry for years. Generally, the popularity of such machines with players is dependent on the likelihood (or perceived likelihood) of winning money at the machine and the intrinsic entertainment value of the machine relative to other available gaming options. Where the available gaming options include a number of competing machines, and the expectation of winning at each machine is roughly the same (or believed to be the same), players are most likely to be attracted to the most entertaining and exciting of the machines. Accordingly, in the competitive gaming industry, there is a continuing need for slot machine manufacturers to produce new types of games, or enhancements to existing games, which will attract frequent play by enhancing the entertainment value and excitement associated with the game.

SUMMARY OF THE INVENTION

A slot machine comprises a plurality of mechanical or video simulated reels. Each reel bears a plurality of discrete symbols. In response to a wager, the reels are rotated and stopped to place a portion of each reel in visual association with a display area. An array of symbols forms in this display area with a number of different pay lines extending through the array. Typically, a wager may be placed on all or selected pay lines. Active pay lines are those on which a wager has been placed. Winning combinations of symbols occurring on an active pay line receive a payout.

Dependent upon the discrete symbols and their position in the array formed from the play of the basic game (i.e., basic array), a start-bonus outcome may occur that allows the player to participate in a bonus game. For example, in one embodiment, the start-bonus game outcome may be the occurrence of a winning pay line. Symbols on the winning pay line are replaced to create a bonus array; the remaining symbols in the bonus array remain the same and in their original basic array position. The replacement symbols are randomly determined. Once the symbols are replaced, the bonus array may contain winning symbol combinations. If the bonus array forms a winning symbol combination on an active pay line (i.e., a winning pay line), a second start-bonus game outcome may be triggered and the process continues until an array is created that does not form a winning outcome.

BRIEF DESCRIPTION OF THE DRAWINGS

The foregoing and other advantages of the invention will become apparent upon reading the following detailed description and upon reference to the drawings in which.

Figure 1:
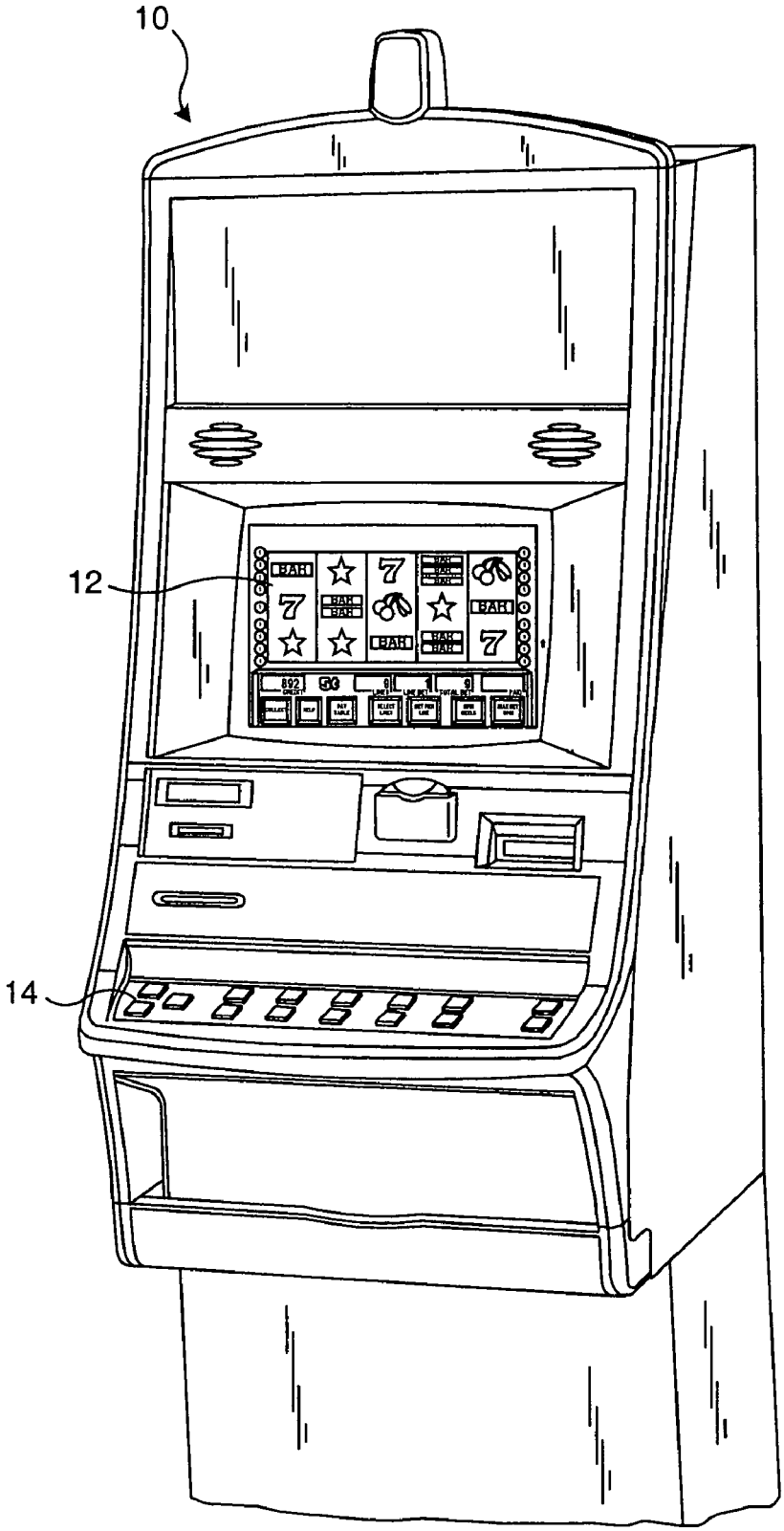
FIG. 1 is an isometric view of an electronic slot machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. The invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, a slot machine 10 is operable to play a wagering game. The wagering game features a basic game with five spinning reels and a bonus game triggered by a start-bonus outcome in the basic game. The reels may be simulated on a video display 12 or alternatively, may be physical reels driven by stepper motors.

If the reels are simulated on the video display 12, the display 12 may be in the form of a dot matrix, CRT, LED, LCD, electro-luminescent, or other type of video display known in the art. The video display 12 may include a touch sensitive screen that allows players to provide input to the gaming machine (e.g., game selections) by simply touching the screen. In the illustrated embodiment, the slot machine 10 is an "upright" version in which the display 12 is oriented vertically relative to the player. Alternatively, the slot machine may be a "slant-top" version in which the display 12 is slanted at about a thirty-degree angle toward the player of the slot machine 10.

Figure 2:
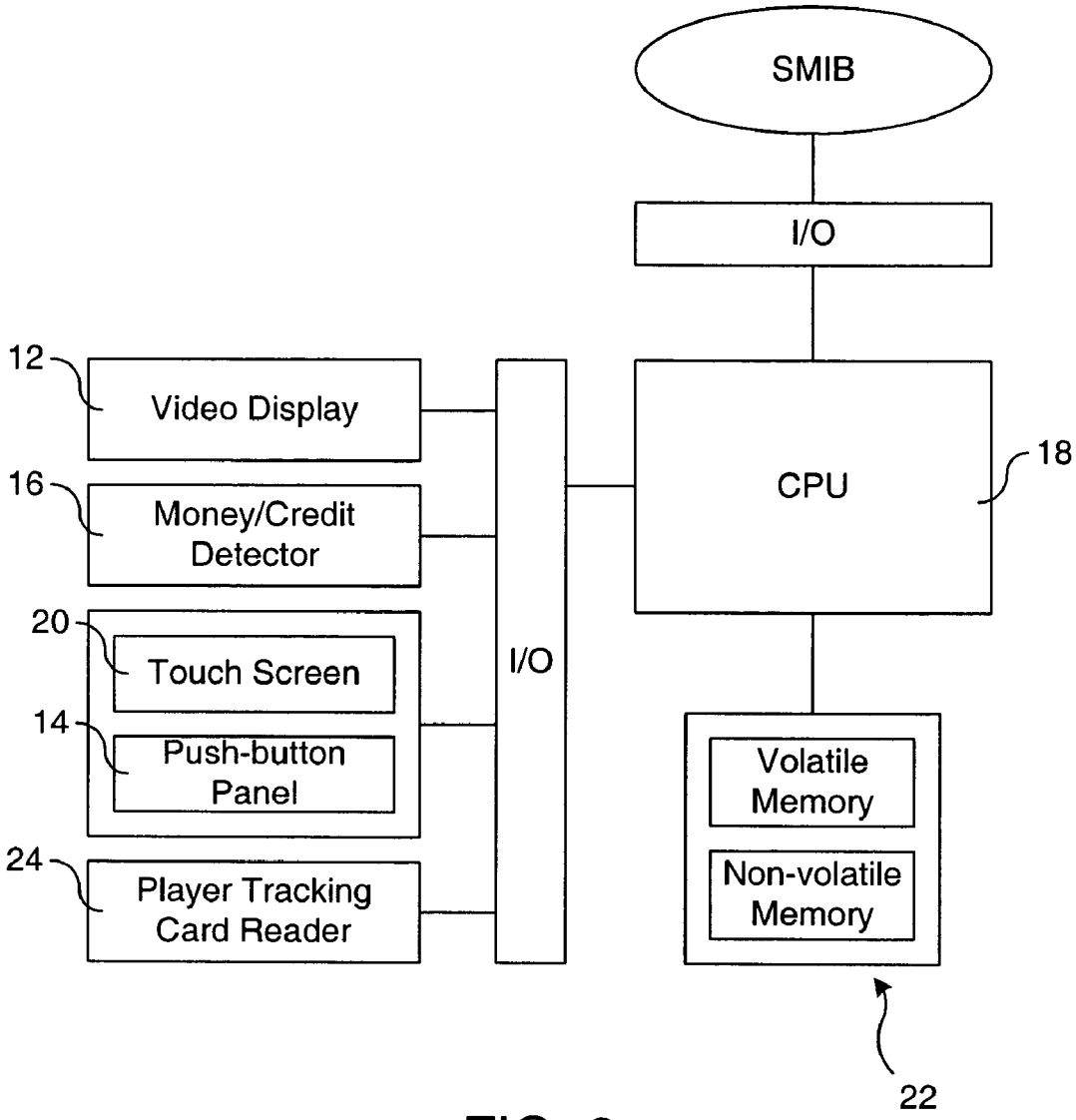
FIG. 2 is a block diagram of a control system suitable for operating a slot machine.

FIG. 2 is a block diagram of a control system suitable for operating the slot machine 10. Money/credit detector 16 signals a central processing unit ("CPU") 18 when a player has inserted money or played a number of credits. The money may be provided by coins, bills, tickets, coupons, cards, etc. The player may select a number of pay lines to play, an amount to wager, and start game play via the touch screen 20 or the push-buttons 14.

A system memory 22 stores control software, operational instructions and data associated with the slot machine 10. The system memory 22 also contains a probability table to help determine the outcome of each game. In one embodiment, the system memory 22 comprises a separate read-only memory (ROM) and battery-backed random-access memory (RAM). It will be appreciated, however, that the system memory 22 may be implemented on any of several alternative types of memory structures or may be implemented on a single memory structure.

A payoff mechanism is operable in response to instructions from the CPU 18 to make an award to the player in response to certain winning outcomes that might occur in the basic game or the bonus game. The payoff may be provided as coins, bills, tickets, coupons, cards, etc. The award amounts are determined by one or more pay tables stored in the system memory 22.

Once a wager has been received and the game activated, the CPU 18 sets the reels in motion, randomly selects a game outcome, and stops the reels to display discrete symbols forming a basic array corresponding to the pre-selected game outcome. The game outcome that produces this basic array may trigger a bonus game when a start-bonus outcome is present in the basic array.

Figure 3:
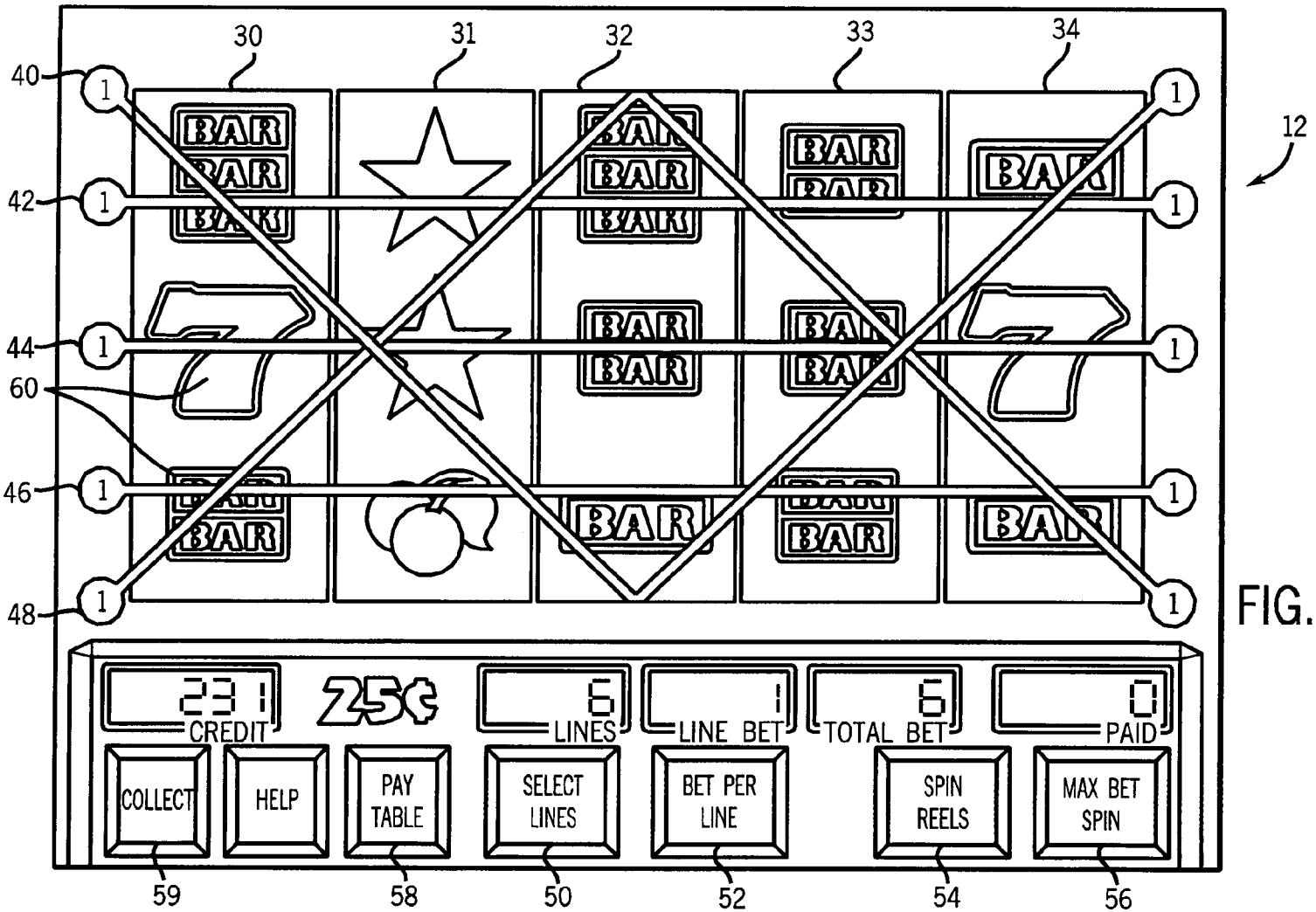
FIG. 3 is a display screen from the slot machine of FIG. 1 displaying the available pay lines.

Referring to FIG. 3, the basic game is implemented on the video display 12 on five simulated spinning reels 30-34 with five pay lines 40, 42, 44, 46, and 48. The number of reels and the number and configuration of the pay lines may be varied from that shown. Each of the pay lines 40, 42, 44, 46, and 48 extends through one discrete symbol 60 on each of the five reels 30-34. Each reel bears a plurality of discrete symbols 60.

Generally, game play is initiated by inserting money or playing a number of credits, causing the CPU to activate a number of pay lines corresponding to the amount of money or number of credits played. In one embodiment, the player selects the number of pay lines (e.g., between one and six as shown in FIG. 3) to play by pressing a "Select Lines" key 50 on the video display 12. The player then chooses the number of coins or credits to bet on the selected pay lines by pressing the "Bet Per Line" key 52. Pay lines on which the player has wagered become active pay lines and any winning combination of symbols appearing on those active pay lines is eligible for an award.

After activation of the pay lines, the reels 30-34 may be set in motion by touching the "Spin Reels" key 54 or, if the player wishes to bet the maximum amount per line, by using the "Max Bet Spin" key 56 on the video display 12. Alternatively, other mechanisms such as a lever or push button may be used to set the reels in motion.

The CPU uses a random number generator in conjunction with a probability table to select a game outcome (e.g., a "basic" game outcome) corresponding to a particular set of discrete reel "stop positions." At least one random number is associated with each possible stop position. The random number generated is used to look up the corresponding reel stop position in the probability table. The CPU then causes each of the reels 30-34 to stop at the appropriate stop position. The discrete symbols 60 graphically illustrate the stop positions and indicate whether the stop positions of the reels represent a winning game outcome.

Winning game outcomes are winning symbol combinations formed from discrete symbols in the array. Each discrete symbol that forms a winning symbol combination is a winning symbol. Winning symbol combinations result in a monetary award (such as currency, chips, or credits) or a prize. The pay table identifies the award associated with each winning symbol combination. In one embodiment, the pay table is affixed to the machine 10 and/or displayed by the video display 12 in response to a command by the player (e.g., by pressing the "Pay Table" button 58).

The winning symbol combinations may be independent or dependent on their position in the array. When dependent on their position in the array, pay lines may be used to indicate the required position of the winning symbols in the array to form a winning game outcome; that is, the winning symbol combination must appear on an active pay line. For example, a winning symbol combination, for example, could be three or more matching discrete symbols 60 along an active pay line: the award increasing as the number of matching symbols along the active pay line increases. This criterion for a winning outcome is used in the discussion of all the embodiments shown in the figures. It should be appreciated, however, that any number of other criteria may be established to identify a winning outcome. For example, a player may be able to form a winning combination with only a single symbol, two symbols, a wild symbol, a special symbol, or any other combination of symbols desired: dependent or independent of pay line configuration.

If the displayed discrete symbols 60 stop in a winning combination on an active pay line, the game credits the player an amount corresponding to the pay table award for that combination multiplied by the credits bet on the winning pay line. The player can collect accumulated credits by pressing the "Collect" button 59. In one embodiment, the winning combinations start from the first reel 30 (left to right) and span adjacent reels. In an alternative embodiment, the winning combinations start from either the first reel 30 (left to right) or the fifth reel 34 (right to left) and span adjacent reels. In still another embodiment, a winning symbol combination may be found anywhere along the pay line. This embodiment, which determines a winning combination regardless of the position of the winning symbols on the pay line, is described below.

Figure 4:
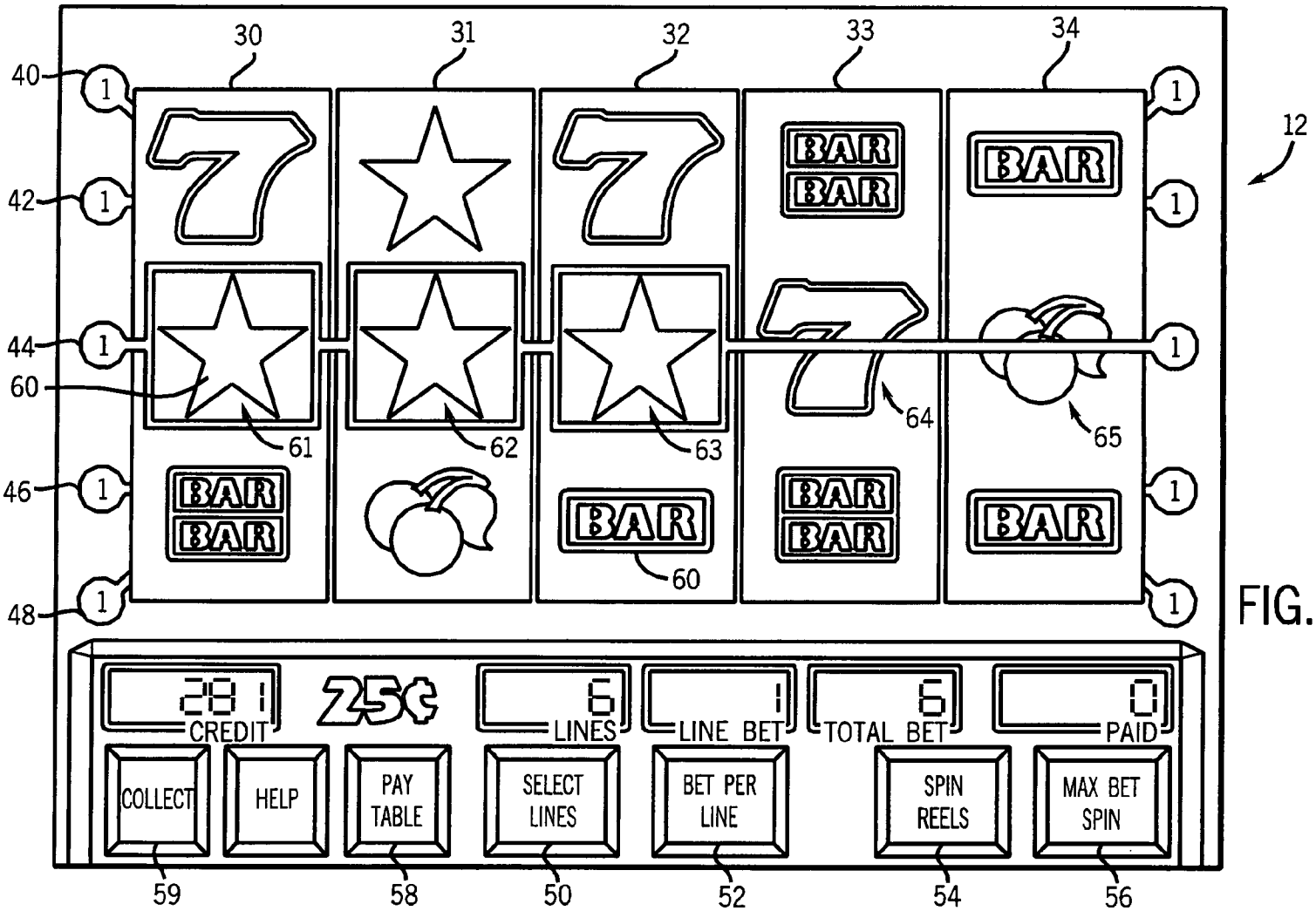
FIG. 4 is a display screen from the slot machine of FIG. 1 displaying a basic game outcome for the slot machine of FIG. 1 with a start-bonus outcome.

Turning to FIG. 4, a winning pay line 44 is shown. The graphically framed symbols (i.e., the stars in array locations 61, 62, and 63) denote the three winning symbols on winning pay line 44 that are eligible for the corresponding award listed in the pay table. The connecting line extending between the framed winning symbols to the pay line indicia 44 graphically illustrates the winning pay line for the player. Although the connecting line intersects the seven and cherry symbols in array location 64 and 65 respectively, these symbols do not count toward a winning outcome, as the symbols are not framed.

In addition to winning game outcomes, the basic game may also include a start-bonus outcome for triggering play of a bonus game. The basic game produces the original or first array; the bonus game is any array formed after the original array because of a start-bonus feature in any immediately preceding array.

A start-bonus outcome may be defined in any number of ways. The start-bonus outcome may be any symbol or symbol combination, dependent or independent of its location in the array or on a pay line. The start-bonus outcome may require the combination of discrete symbols to appear along an active pay line, or alternatively, may allow the combination of discrete symbols to appear anywhere on the display. A start-bonus outcome may be a winning or non-winning outcome.

For example, the start-bonus outcome may be a non-winning outcome when it occurs because of a start-bonus symbol or a combination of start-bonus symbols that appear on one or more of the reels 30-34. The start-bonus symbol (or symbols) may occur in the basic or bonus game and function as a start-bonus trigger. This start-bonus symbol may not be present in the pay table, and may not receive a monetary payout, but can still trigger a bonus game. Alternatively, in one embodiment, the start-bonus game outcome is any winning game outcome in the basic or bonus game. The criteria for such a start-bonus outcome is shown in FIG. 4 along winning pay line 44.

Figure 5:
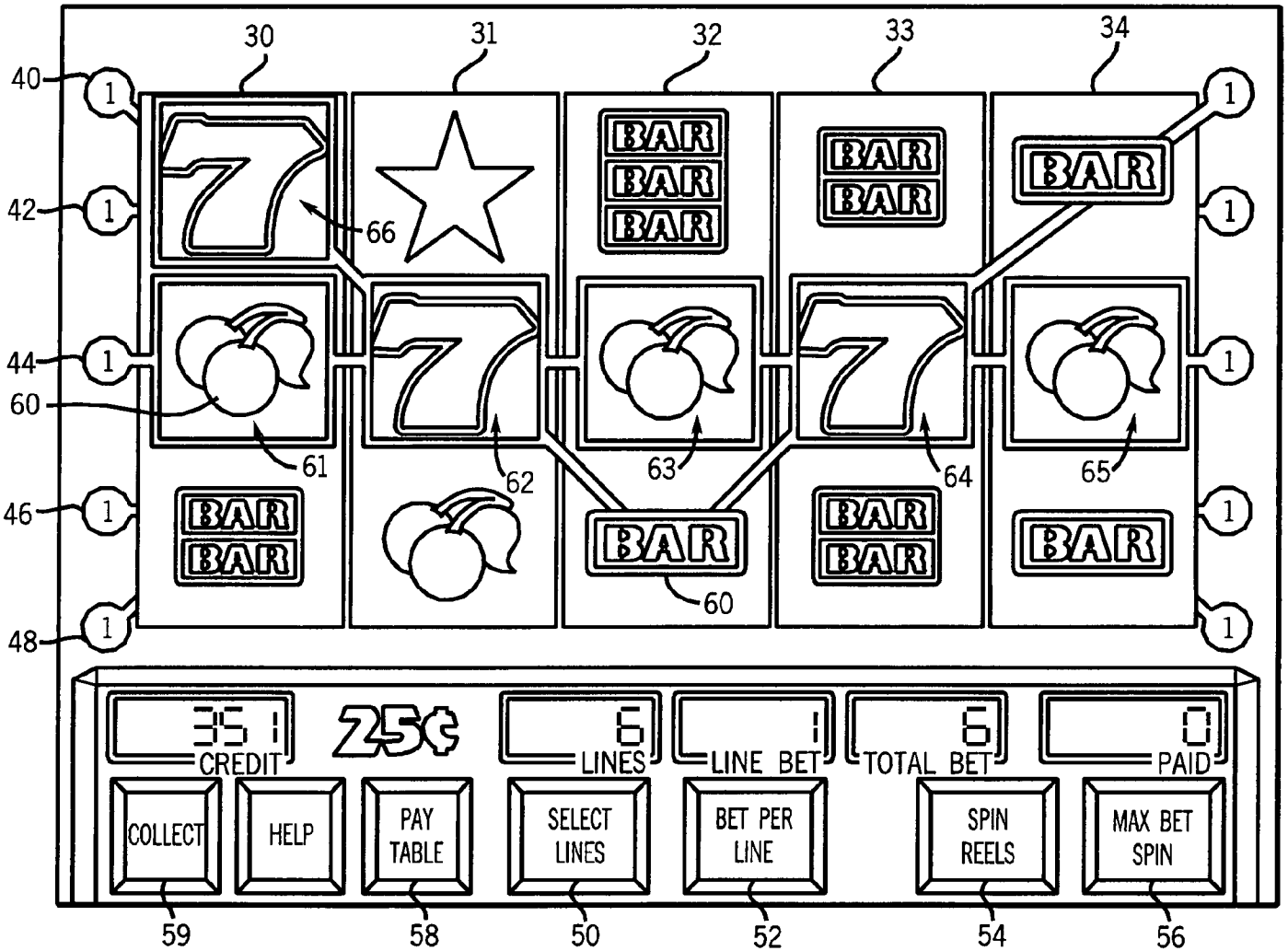
FIG. 5 is the display screen of FIG. 4 with the winning symbols replaced with randomly determined replacement symbols to form a bonus array.

The appearance of the start-bonus outcome causes the CPU to shift operation from the basic game to the bonus game. At the commencement of the bonus game, discrete symbols 60 along the winning pay line disappear from reels 30-34 and are replaced with randomly generated symbols. In one embodiment, all of the symbols along the winning pay line are replaced. In another embodiment, only the symbols that created the winning condition (i.e., winning symbols) are replaced. For example, rather than regenerating all the symbols associated with the winning pay line in FIG. 4, only the symbols associated with the winning condition (i.e., the symbols in array location 61, 62, and 63) are replaced. FIG. 5 shows the bonus array formed after the winning symbols from the basic array are randomly replaced.

The CPU determines if the bonus array has a winning outcome. One winning outcome is a winning combination of symbols along an active pay line similar to a winning outcome in the basic game. In one embodiment, the same active pay lines in the original basic game are used in the bonus game, i.e., the active pay lines from the original basic game carry over to each subsequent bonus game. The active pay lines do not change by virtue of the regenerated array.

It should be appreciated that it may be possible to have more than one winning pay line in an array. The number and geometric complexity of the pay lines through each discrete symbol 60 of the array can potentially trigger a number of new winning pay lines—even from a minimal number of regenerated symbols. As shown in FIG. 5, two winning pay lines have been formed: one along pay line 40 and another along pay line 44. The winning symbols along pay line 44 are the three cherry symbols in array location 61, 63, and 65 (the two seven symbols in array positions 62 and 64 do not count toward a winning combination). The winning symbols along pay line 40 include the three 7's in array positions 66, 62, and 64 (the two single bar symbols do not count toward a winning combination). In one embodiment, the player is paid for both winning pay lines; in an alternate embodiment, the player may only be paid for the pay line with the largest award.

The occurrence of multiple pay lines in the array can affect game play development in at least two ways. In one embodiment, all winning pay lines are regenerated simultaneously to form a bonus array. If a new winning combination along an active pay line is formed, the bonus game continues.

Alternatively, each winning pay line may be separately regenerated. The player may interact with the game and select the pay line that is to be regenerated first. If the regenerated pay line generates a winning combination on an active pay line, another array is generated from the winning pay line. The process continues until a generated array does not contain a winning combination on an active pay line; the player may then select the second winning pay line from the original array to have that pay line regenerated. If the bonus array contains a winning combination on an active pay line, a new array is generated. The process continues until the array generated no longer contains a winning outcome and the player has generated bonus arrays from all the original winning pay lines. This method, however, of allowing a player to regenerate winning pay lines on an individual basis to determine new arrays is potentially overly rewarding to the player and may not easily support the desired pay back percentage.

Figure 6:
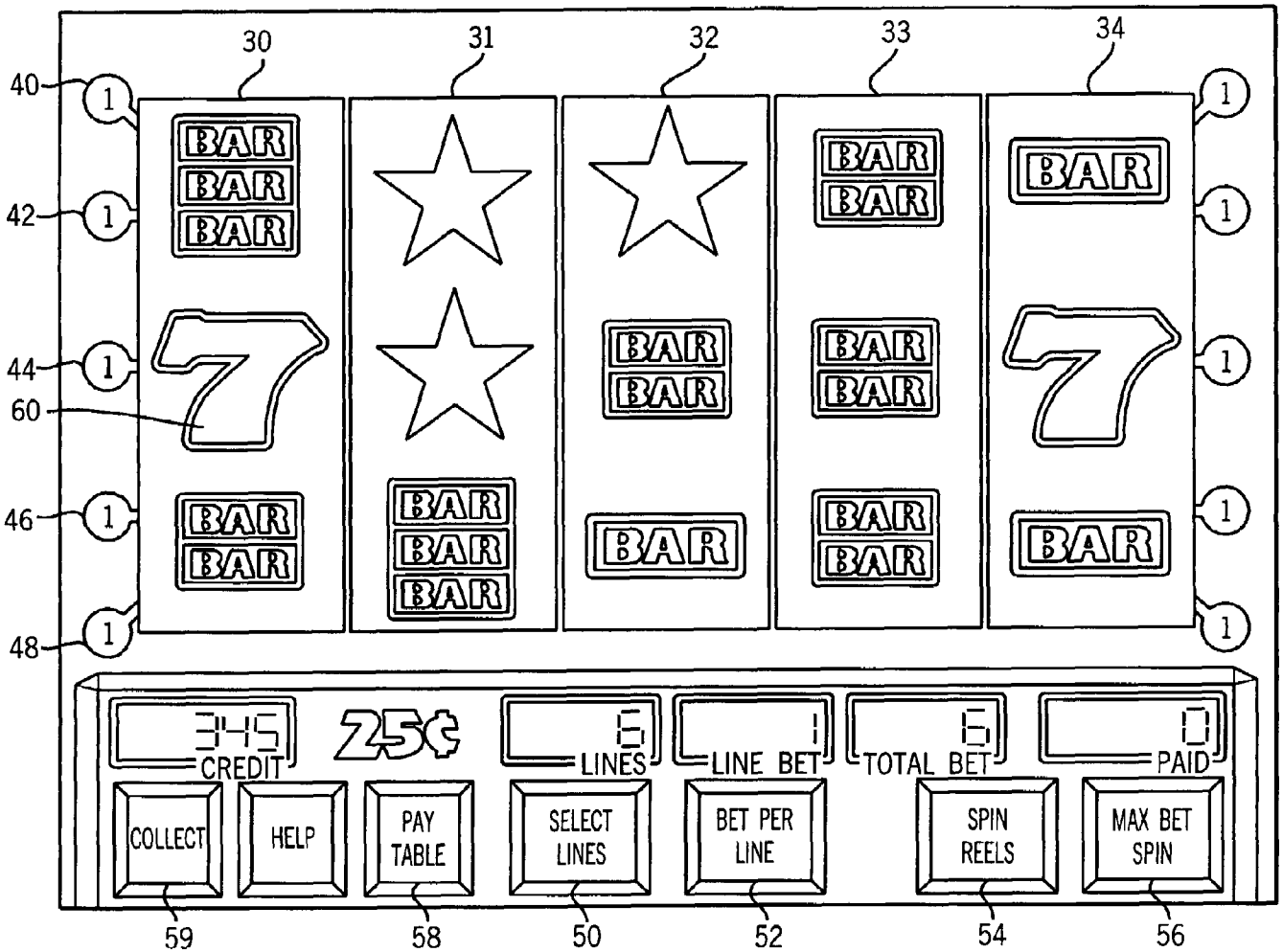
FIG. 6 is the display screen of FIG. 5 with the winning symbols replaced with randomly determined replacement symbols to form a second bonus array.

In contrast, regenerating all the winning symbols (or all the symbols) occurring on the winning pay lines simultaneously to produce a single bonus array provides a more simplistic and more easily understandable game play dynamic for the player. FIG. 6 illustrates this game play dynamic. FIG. 6 shows all the winning symbols from FIG. 5 regenerated simultaneously to produce a single bonus array outcome. In this example, none of the new randomly generated symbols has created a winning outcome. Consequently, the game is over and the player must now place a new wager on the basic game to continue play on the gaming machine.

Figure 7:
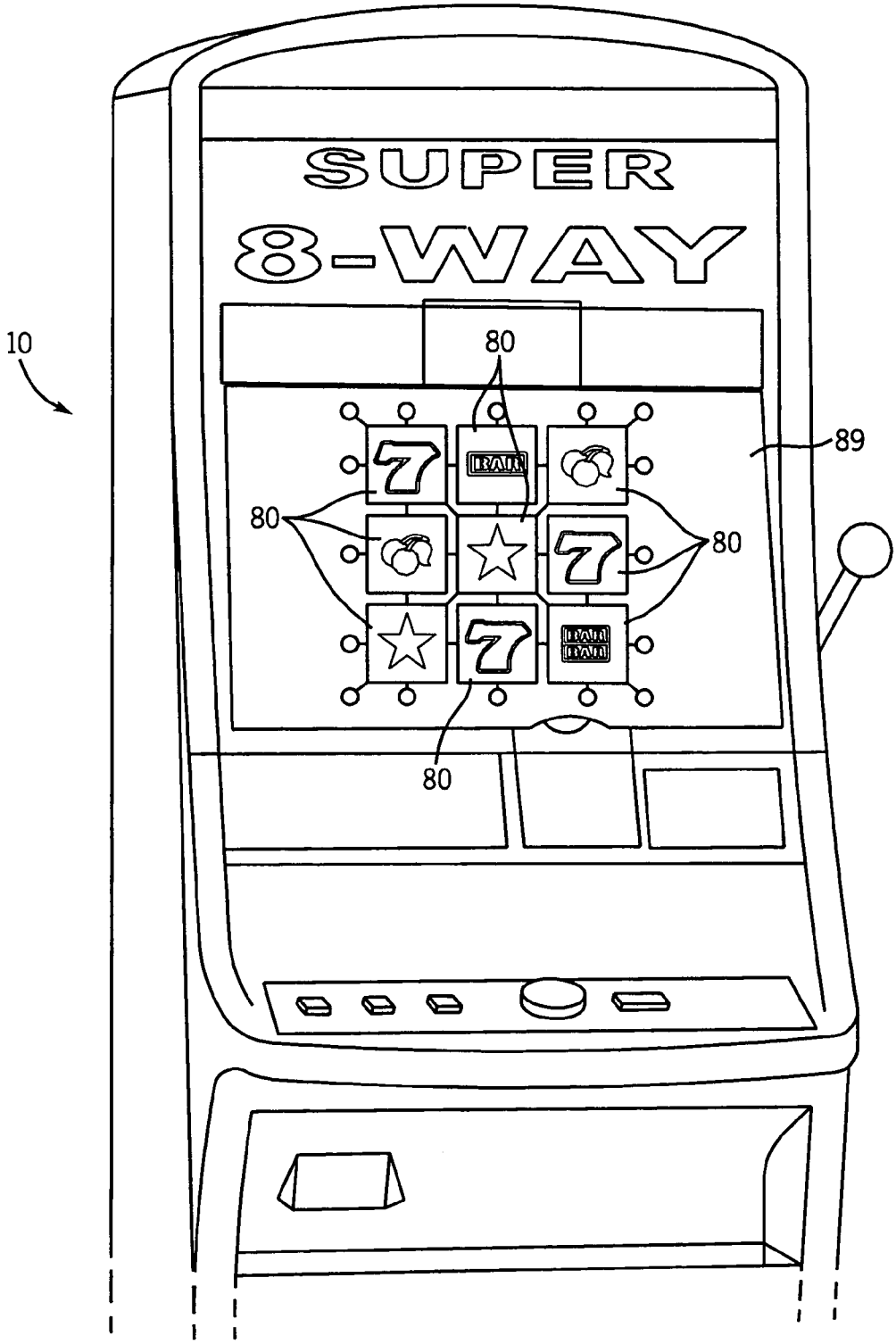
FIG. 7 is an isometric view of an electromechanical slot machine embodying the present invention.

Although the wagering game discussed in the above embodiment uses a video display, the wagering game described is equally applicable to gaming machines using mechanical reels. A standard mechanical slot machine, such as a three mechanical reel slot with a single pay line, could be utilized in this application. More entertaining game play can be achieved, however, using slot machines having individual mechanical reels that display a single symbol. An example of this type of slot machine is shown in FIG. 7. As can be seen from FIG. 8 (which illustrates the game display of FIG. 7 in detail) each of the polyhedral cubes represents a separate mechanical reel mechanism. Each of the reel mechanisms when stopped displays a single symbol 60 to form an array 89—either a basic game array or a bonus game array. Other polyhedral shapes can also be utilized such as triangular polyhedrons.

Further, rather than using polyhedral reels to display symbols, the more familiar circular reel may be used. The circular reels required in this application depart from the more traditional design in that only a single symbol is displayed in the stopped position. Consequently, in this design, nine separate circular reels would be used in the gaming machine shown in FIG. 7.

Each of the mechanical reels is independently controllable—the CPU selects which of the reels to re-spin while the remaining reels are held in place, unaffected by the re-spun reels. The game play is the same as described above for the electronic gaming machine.

Figure 8:
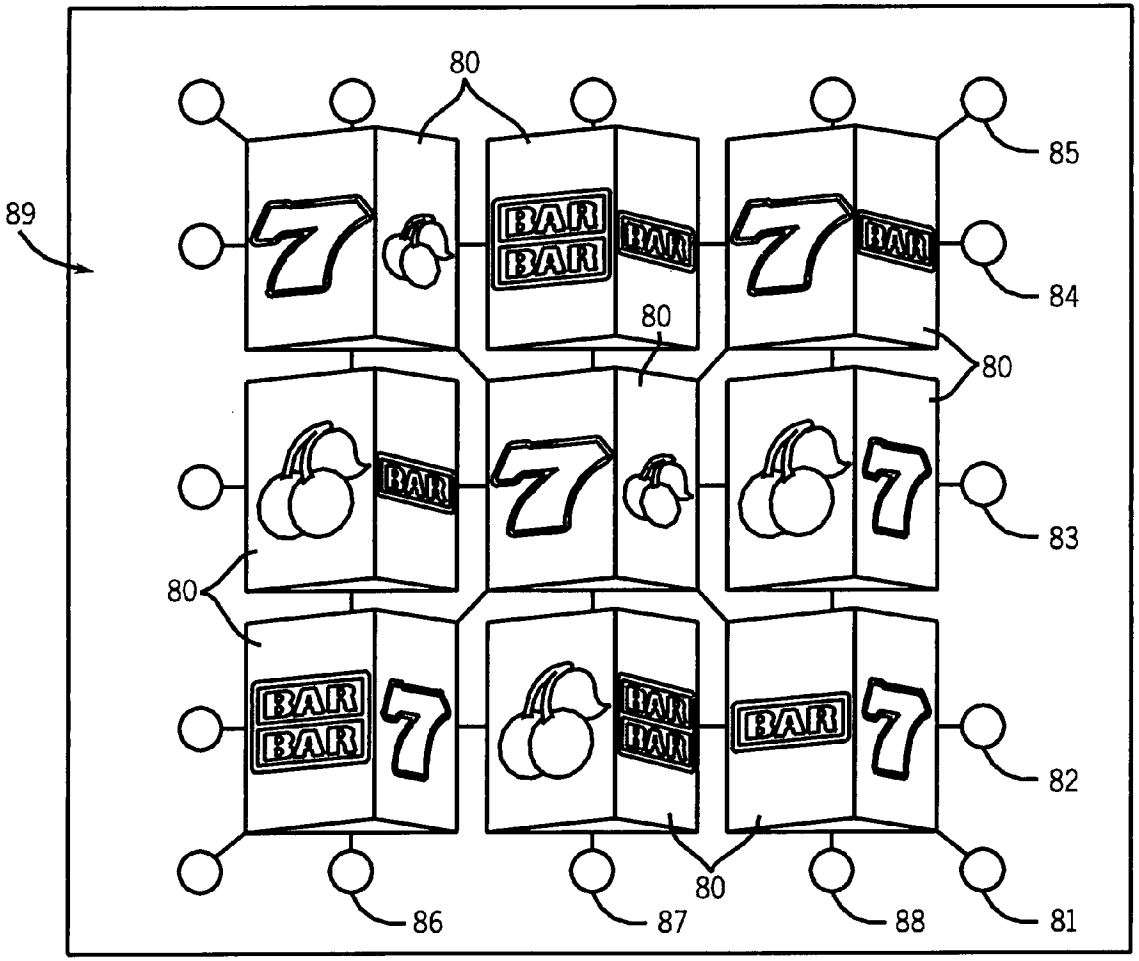
FIG. 8 is the display of the electromechanical slot machine of FIG. 7 with the mechanical reels spinning before the display of the basic game outcome.
Figure 9:
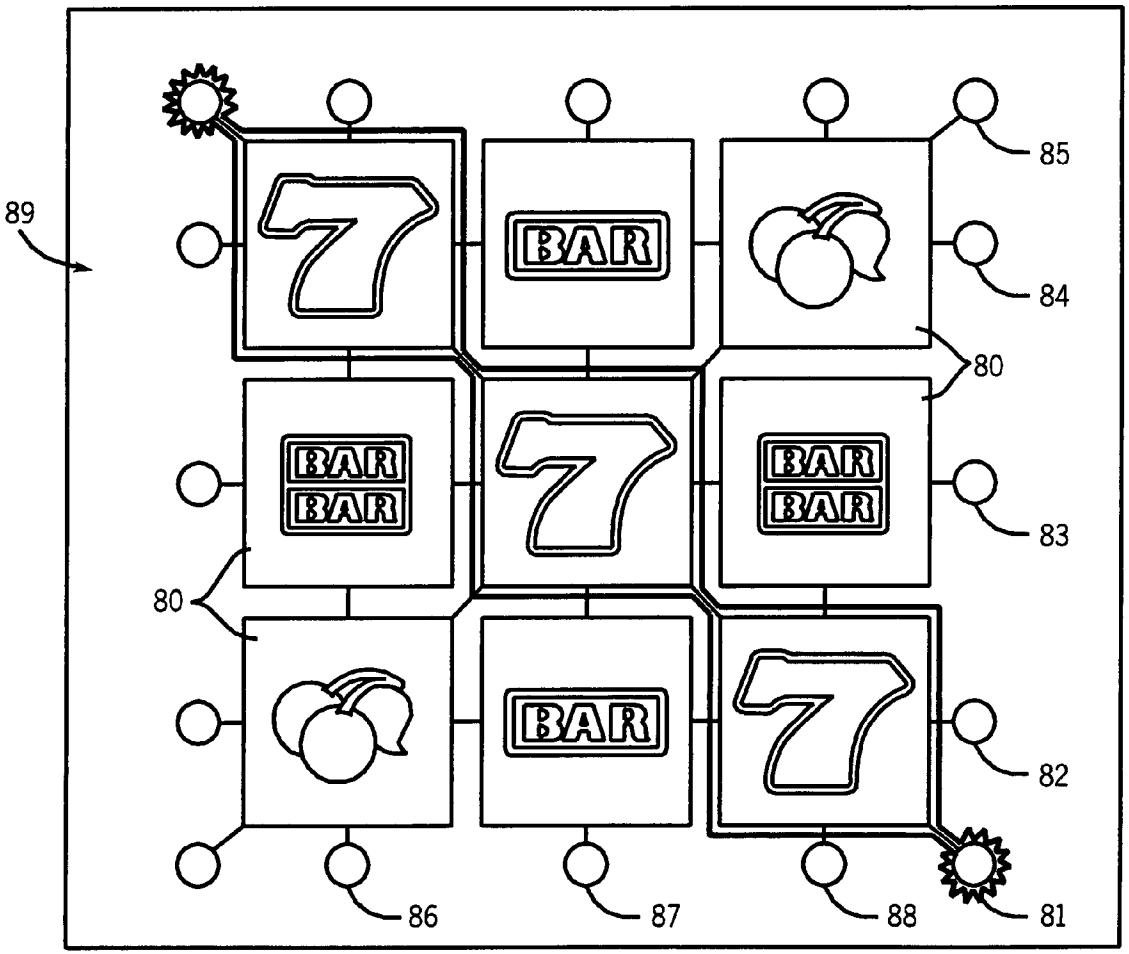
FIG. 9 is the display of FIG. 8 showing a basic game outcome for the slot machine of FIG. 7.

Turning to FIG. 8, pay lines 81-88 are shown. These pay lines extend horizontally, vertically, and diagonally through the array. In this game, any three identical symbols on a pay line form a winning pay line, and consequently, all symbols forming a winning pay line are winning symbols. FIG. 8 shows each of the nine discrete mechanical reels 80 spinning before they display the random outcome for the basic game. FIG. 9 shows a winning pay line 81 with triple sevens for which the player is awarded per the pay table. For the purposes of describing this embodiment, any winning pay line in the basic game triggers the start-bonus game. Consequently, the triple seven winning pay line in the basic game shown in FIG. 9 gives the player a chance at the bonus game.

Figure 10:
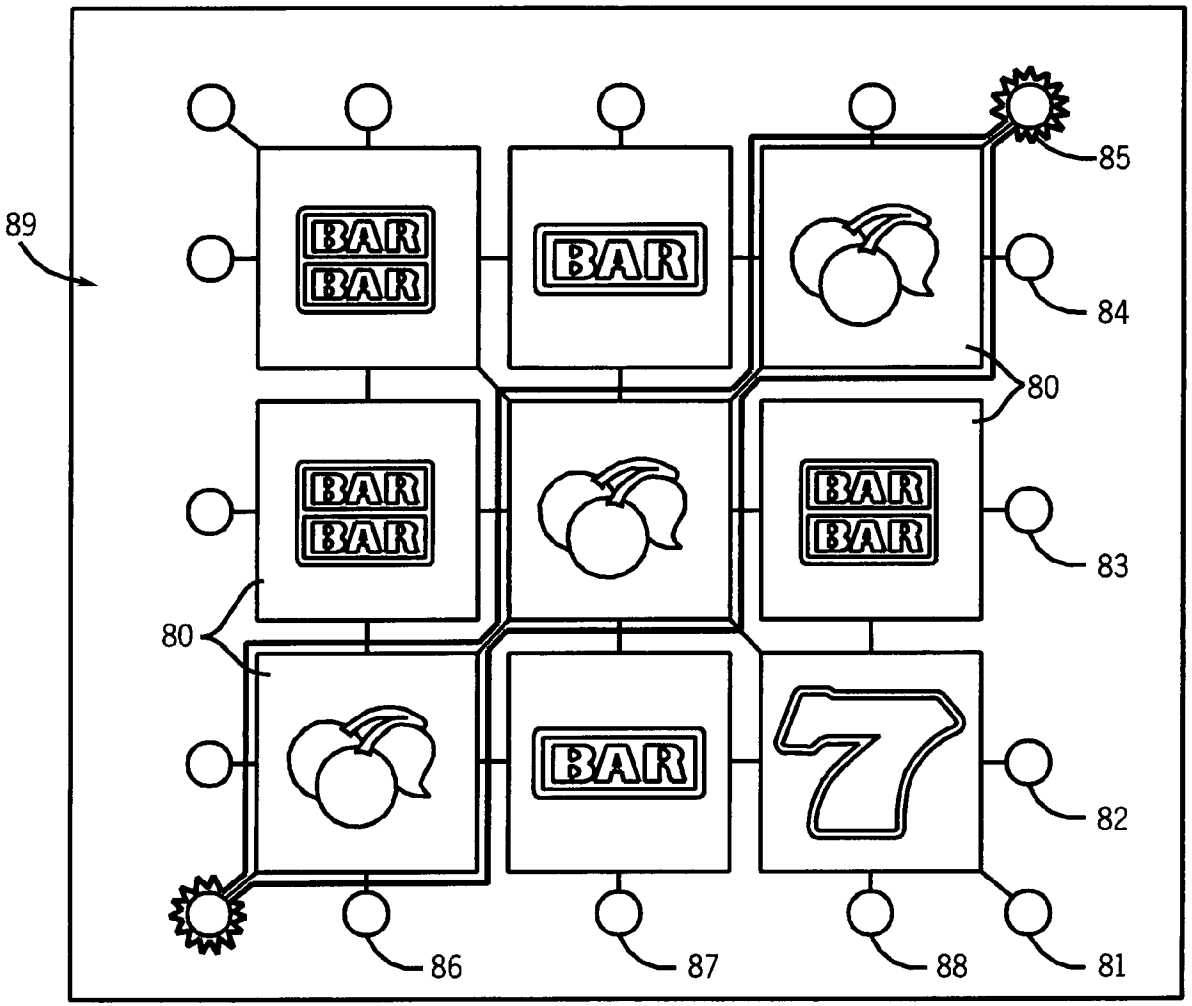
FIG. 10 is the display of FIG. 9 with the winning symbols replaced with randomly determined replacement symbols to form a bonus array.
Figure 11:
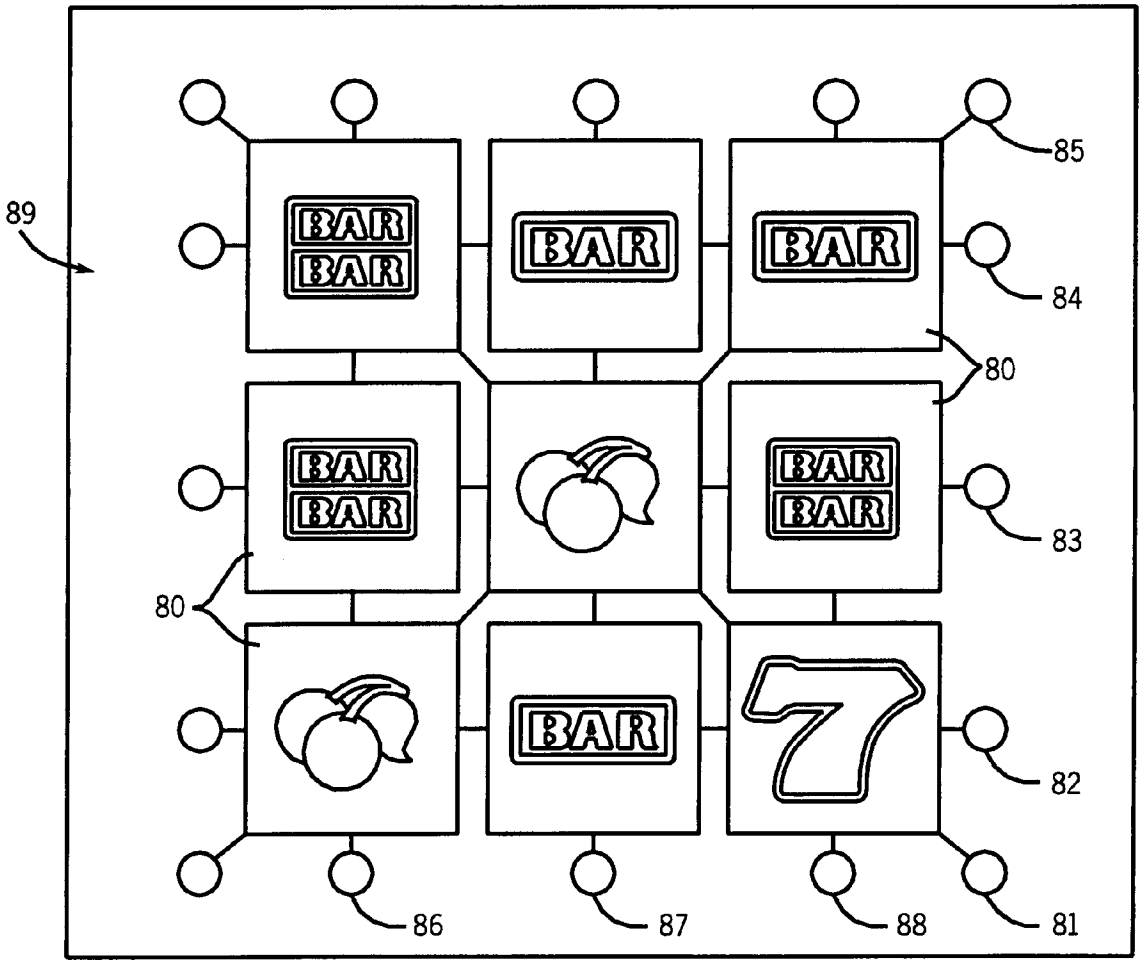
FIG. 11 is the display of FIG. 10 with the winning symbols replaced with randomly determined replacement symbols to form a second bonus array.

The CPU randomly determines replacement symbols for the winning symbols of FIG. 9. The bonus array shown in FIG. 10 was formed from the replacement of the winning symbols of FIG. 9 with randomly determined replacement symbols. All of the non-winning symbols remain the same as shown in the original basic array shown in FIG. 9. Because of the replacement symbols, the bonus array of FIG. 10 has a new winning pay line 85 (three cherries). The player is awarded for a three cherry pay line according to the pay table. Because the player has again achieved a winning pay line, the winning symbols on that pay line are replaced with new randomly determined symbols to form a second bonus array (also the third array formed for the wagering game) as illustrated by FIG. 11. The second bonus array is formed by replacing all the cherries on pay line 85 with the randomly determined replacement symbols. Unfortunately for the player, the second bonus array does not contain any winning pay lines. Consequently, the game is over and the player must wager on a new basic game. Otherwise, a player who consecutively wins a pay line in the bonus array may continue to play until a non-winning array is formed.

Further variations of the game are possible. For example, another type of winning outcome that may occur, in either the basic or bonus game, is called a scatter pay. A scatter pay is a winning combination of symbols that is independent of the symbols' position in the array or on a pay line. For example, a scatter pay can be a predetermined number of occurrences of a specified symbol or symbol combination anywhere in the array. Depending upon the number and type of symbols, the pay table will assign an award for the winning symbol combination. Such a scatter pay may trigger a start-bonus outcome that provides a player with a bonus array. Each symbol that forms a scatter pay is a winning symbol and is randomly regenerated to create a bonus array. Winning pay lines or scatter pays in the bonus array are then paid. As a result of a winning outcome in the first bonus array, a second bonus array may be formed in the same manner as discussed in the above embodiments.

Still another variation of this wagering game occurs when a wild symbol is present in the array. Wild symbols may generally represent any necessary symbol to complete a winning pay line. Each wild symbol that forms a winning combination is a winning symbol. A wild symbol may be locked in place, even if it occurs on a winning pay line, giving a player a significant advantage in the bonus array. Alternatively, the wild symbol, if it forms a winning combination, may be replaced similarly to any other winning symbol to form a new array.

Another variation utilizes separate pay tables: one for the basic game and another for the bonus game. Different pay structures may be used in the basic and bonus game to increase the action of the bonus game by adjusting either the pay or the probability table.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of conducting a wagering game on a gaming machine, comprising:

receiving a wager from a player to initiate play of the wagering game;

receiving a selection of at least one of a plurality of pre-defined player-selectable pay lines;

randomly selecting a plurality of symbols to form a first array;

displaying the first array;

identifying winning symbols in the first array that form any first winning combination along one or more pay lines of the plurality of pre-defined player-selectable pay lines;

awarding the player for the first winning combination in the first array if the first away contains the first winning combination along one or more pay lines of the plurality of pre-defined player-selectable pay lines;

replacing one or more of the winning symbols in the first away that form the first winning combination with a randomly determined replacement symbol to form a second array;

displaying the second array;

identifying winning symbols in the second array that form any second winning combination along one or more pay lines of the plurality of pre-defined player-selectable pay lines; and awarding the player for the second winning combination in the second array.

2. The method of conducting a wagering game as described in claim 1, wherein less than all of the winning symbols that form the first winning combination are replaced.

3. The method of conducting a wagering game as described in claim 1, wherein a wild symbol is one of the winning symbols forming the first winning combination and is not replaced.

4. The method of conducting a wagering game as described in claim 1, wherein the wagering game includes a basic wagering game and a bonus wagering game, the basic wagering game having a pay structure that is paid in accordance with a basic pay table, the bonus wagering game including the displaying of the first away and the displaying of the second array, at least one of the awarding for the first winning combination and the awarding for the second winning combination being based on a pay structure that is paid in accordance with its own bonus pay table, the bonus pay table being different than the basic pay table.

5. The method of conducting a wagering game as described in claim 4, wherein the awarding for the first winning combination is based on a first bonus pay table and the awarding for the second winning combination is based on a second bonus pay table.

6. The method of conducting a wagering game as described in claim 1, wherein the wager is for each of the at least one of the plurality of pre-defined player-selectable pay lines that is selected.

7. The method of conducting a wagering game as described in claim 1, wherein the wagering game includes a basic wagering game and a bonus wagering game, the basic wagering game having a pay structure that is paid in accordance with a basic probability table, the bonus wagering game including the displaying of the first array and the displaying of the second array, at least one of the awarding for the first winning combination and the awarding for the second winning combination being based on a pay structure that is paid in accordance with its own bonus probability table, the bonus probability table being different than the basic probability table

8. The method of conducting a wagering game as described in claim 7, wherein the awarding for the first winning combination is based on a first bonus probability table and the awarding for the second winning combination is based on a second bonus probability table.

9. The method of conducting a wagering game as described in claim 1, wherein a wild symbol is one of the winning symbols on at least one of any first winning combination and any second winning combination along one or more pay lines of the plurality of pre-defined player-selectable pay lines and is not replaced.

10. A gaming machine for conducting a wagering game, comprising:

a value input device for receiving a wager from a player to initiate play of the wagering game;

a display for displaying a first away of symbols in visual association with a plurality of pre-defined player-selectable pay lines, the first array being formed by randomly selecting a plurality of symbols; and a controller coupled to the display and operative to receive player selections from the player of at least one of the plurality of pre-defined player-selectable pay lines to identify at least one player-selected pay line, identify a first winning symbol in the first array that creates any first winning outcome along the at least one player-selected pay line;

award the player for the first winning outcome;

replace the first winning symbol with a randomly determined first replacement symbol to form a second array;

display the second array;

identify a second winning symbol in the second away that creates any second winning outcome along the at least one player-selected pay line; and award the player for the second winning outcome.

11. The gaming machine for conducting a wagering game as described in claim 10, wherein the controller is further operative to:

replace the second winning symbol with a randomly determined second replacement symbol to form a third array;

display the third array;

identify a third winning symbol in the third array that forms any third winning outcome along the at least one player-selected pay line; and award the player for the third winning outcome.

12. The gaming machine for conducting a wagering game as described in claim 10, wherein the wagering game includes a basic wagering game and a bonus wagering game, the basic wagering game having a pay structure that is paid in accordance with a basic pay table, the bonus wagering game including the displaying of the first array and the displaying of the second array, at least one of the award for the first winning outcome and the award for the second winning outcome being based on a pay structure that is paid in accordance with a bonus pay table, the bonus pay table being different than the basic pay table.

13. The gaming machine for conducting a wagering game as described in claim 12, wherein the awarding for the first winning outcome is based on a first bonus pay table and the awarding for the second winning outcome is based on a second bonus pay table.

14. The gaming machine for conducting a wagering game as described in claim 10, wherein the wager is for the at least one player-selected pay line.

15. The gaming machine for conducting a wagering game as described in claim 10, wherein the wagering game includes a basic wagering game and a bonus wagering game, the basic wagering game having a pay structure that is paid in accordance with a basic probability table, the bonus wagering game including the displaying of the first away and the displaying of the second array, at least one of the award for the first winning outcome and the award for the second winning outcome being based on a pay structure that is paid in accordance with a bonus probability table, the bonus probability table being different than the basic probability table.

16. The gaming machine for conducting a wagering game as described in claim 15, wherein the award for the first winning outcome is based on a first bonus probability table and the award for the second winning outcome is based on a second bonus probability table.

17. The gaming machine for conducting a wagering game as described in claim 10, wherein the controller is further operative to shift the first replacement symbol in the first array to fill a position of the first array that is occupied by the first winning symbol prior to the replacing of the first winning symbol.

18. The gaming machine for conducting a wagering game as described in claim 10, wherein the controller is further operative to identify another first winning symbol in the first array; and shift another first replacement symbol in the first array to fill a position of the first away that is occupied by the another first winning symbol prior to being replaced by the another first replacement symbol.

19. The gaming machine for conducting a wagering game as described in claim 10, wherein the display includes displaying a first bonus pay table associated with a pay structure for the first winning outcome, a second bonus pay table associated with a pay structure for the second winning outcome, and a basic pay table associated with a pay structure for a basic wagering game.

20. A computer readable storage medium encoded with instructions for directing a gaming system to perform the method of claim 1.

* * * * *

UNITED STATES PATENT AND TRADEMARK OFFICE

CERTIFICATE OF CORRECTION

PATENT NO. : 7,604,538 B2
APPLICATION NO. : 10/712951
DATED : October 20, 2009
INVENTOR(S) : Larry J. Pacey It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1658 days.

Signed and Sealed this

Fifth Day of October, 2010

David J. Kappos

David J. Kappos
*Director of the United States Patent and Trademark Office*